United States Patent [19]

Pedersen

[11] Patent Number: 4,530,302

[45] Date of Patent: Jul. 23, 1985

[54] SUBMERGED SINGLE POINT MOORING APPARATUS

[75] Inventor: Kristen I. Pedersen, Houston, Tex.

[73] Assignee: Sofec, Inc., Houston, Tex.

[21] Appl. No.: 478,704

[22] Filed: Mar. 25, 1983

[51] Int. Cl.[3] ..... B63B 21/00

[52] U.S. Cl. ..... 114/230; 141/279

[58] Field of Search ..... 114/230; 441/3-5, 441/279, 387, 388

[56] References Cited

U.S. PATENT DOCUMENTS

| | | | |
|---|---|---|---|
| 2,955,626 | 10/1960 | Hartley | 141/279 |
| 3,409,055 | 11/1968 | Bily | 141/387 |
| 3,472,293 | 10/1969 | Bily | 141/383 |
| 3,479,673 | 11/1969 | Manning | 114/230 |
| 3,722,223 | 3/1973 | Gratz | 114/230 |
| 3,823,432 | 7/1974 | Van Heijst | 114/230 |
| 3,841,501 | 10/1974 | Van Heijst | 114/258 |
| 3,865,064 | 2/1975 | Van Heijst | 114/230 |
| 3,899,990 | 8/1975 | Lacomte | 114/230 |
| 3,908,212 | 9/1975 | Van Heijst | 441/5 |
| 4,010,500 | 3/1977 | Reid, Jr. | 114/230 |
| 4,031,582 | 6/1977 | Van Heijst | 441/3 |
| 4,262,620 | 4/1981 | Nooteboom | 114/230 |
| 4,351,260 | 9/1982 | Tuson et al. | 114/230 |

FOREIGN PATENT DOCUMENTS 0049549 4/1982 European Pat. Off. .

*Primary Examiner*—Sherman D. Basinger

*Attorney, Agent, or Firm*—Dodge, Bush & Moseley

[57] ABSTRACT

A single point mooring apparatus for tanker loading and discharging is disclosed having a submerged base and a submerged rigid yoke connected directly to the base by a triaxial articulation joint for allowing the yoke to move while connected to a vessel in yaw, pitch and roll with respect to the submerged mooring base. The submerged yoke is connected to the vessel with weighted pendants on port and starboard sides of the bow of the vessel, providing a resilient position restoring force to the vessel as the vessel moves in response to wind, wave and currents.

12 Claims, 5 Drawing Figures

SUBMERGED SINGLE POINT MOORING APPARATUS

BACKGROUND OF THE INVENTION

1. Field of the Invention

This invention relates generally to the technology of mooring vessels such as oil tankers, floating barges, and the like, to a station where fluids may be flowed from a producing well or storage area to the vessel. In particular, the invention relates to a single point mooring system for vessels on a body of water.

2. Description of the Prior Art

The exploitation or operation of certain offshore oilfields as well as other industrial applications often requires the mooring of ships or floating vessels which are used for the storage of products and/or the transporting of fluids after extraction from a well.

Single point mooring systems have frequently been used in offshore locations for the loading and unloading of hydrocarbons or other flowable cargos into or out of marine vessels such as tankers, barges and the like. Many such systems have been developed and are now in use for both loading and unloading hydrocarbons at offshore locations. Examples of such conventional systems include the catenary anchor leg mooring (CALM) apparatus and the single anchor leg mooring (SALM) apparatus.

The catenary anchor leg mooring system (CALM) holds a floating buoy by an array or pattern of anchors attached by mooring chains or lines. The vessel which is to be loaded is attached to the floating buoy by suitable mooring ropes or a rigid mooring arm. In such a mooring system the position restoring mooring forces are provided by the horizontal force component in the mooring chains. However, in shallow water it has been difficult to arrange the mooring chains with sufficient slack to provide adequate resiliency or horizontal spring in the mooring system. In such instances, the horizontal movement of a moored vessel caused by external forces due to waves, winds and currents can cause sudden extremely large forces which may exceed the capacity of the mooring system to maintain the vessel in the hydrocarbon transferring mode.

Conventional single anchor leg mooring systems (SALM) have used one floating mooring buoy attached with a suitable chain or articulated arm to a lower base structure fixed to the sea bottom or floor. By submerging the buoy to a certain depth, a desired tension level is created in the anchor leg. The tension provides a constant restoring or horizontal urging force for resiliently mooring a floating vessel to the buoy. In shallow water the vessel position restoring capacity of the SALM mooring system is also reduced and not suitable for mooring large vessels. In general, the conventional SALM system has also not been particularly well suited for use in a location or region where large ice flows may contact or may be expected to impact the mooring buoy.

In view of the disadvantages of the prior art systems for mooring vessels in shallow ice laden waters, there has developed a need for a mooring system which may be completely submerged yet provide resiliency and restoring forces to a moored vessel while keeping it on station.

U.S. Pat. No. 4,351,260, issued in the name of Tuson et al., discloses a submerged single point mooring system in which a weight attached at the mid-point of articulated legs provides a resilient restoring force to the moored vesel. However, the system disclosed in the Tuson patent has a disadvantage in that articulated legs between a submerged tower and the vessel itself may be subject to mechanical instabilities and the like. For that reason, an object of this invention is to provide a fully submerged single point mooring system for a vessel floating on a body of water with an inherent resilient restoring force in response to waves, wind and current acting on the vessel.

It is a further object of this invention to provide a mooring system having a submerged unitary yoke rotatably attached to a fixed submerged base on the ocean floor and adapted to move in response to surge, sway, heave, yaw, pitch and roll motions of the moored vessel.

It is a further object of the invention to provide weighting mounting means on a connecting rigid yoke to secure weighting blocks providing a position restoring force to the vessel.

It is another object of the invention to provide a yoke suspension means with wear free articulations between the yoke and the vessel.

SUMMARY OF THE INVENTION

These and other objects and features of the invention are incorporated in the disclosed mooring system having a submerged mooring base means on which is mounted a triaxial articulation means for connection of one end of a submerged yoke, the other end of the yoke being connected to the vessel by way of a yoke suspension means. The submerged yoke is a unitary structure having a "V" shape with the apex end of the "V" being connected to the triaxial articulation means. The two open arms of the "V" are connected to the vessel by rigid shafts, chains, or wire rope tendons via universal joints attached both on the vessel and to the arms. Weight holding means on the outward ends of the two arms secure heavy weights to the yoke, resulting in large axial tension forces in the yoke suspension means. As the yoke suspension means are inclined as a result of wind, wave and current forces acting on the vessel, the horizontal component of the axial forces in the yoke suspension means attached to the vessel provides a self-actuating restoring force to the vessel.

Flexible conveying hoses extend from the vessel via the yoke suspension means and the yoke to the submerged mooring base means for conveying the flowable cargo to be loaded on the vessel or to be off loaded from the vessel.

The triaxial articulation means comprises a turntable means mounted on the mooring base for rotation about a substantially vertical axis. A coupling means mounted on the turntable means is rotatable about a first pin means with its rotation axis disposed substantially horizontal and parallel to the rotation plane of the turntable. Second pin means, oriented substantially orthogonally to the first pin means, is rigidly mounted with respect to the coupling means and is rotatably connected to the submerged yoke means with its rotation axis aligned substantially along the longitudinal axis of the submerged yoke means.

BRIEF DESCRIPTION OF THE DRAWINGS

The invention will be better understood and further objects, characterizing features, advantages and details thereof will appear more clearly as the following detailed description proceeds with reference to the accompanying drawings of which.

DESCRIPTION OF THE INVENTION

Figures 1, 5:
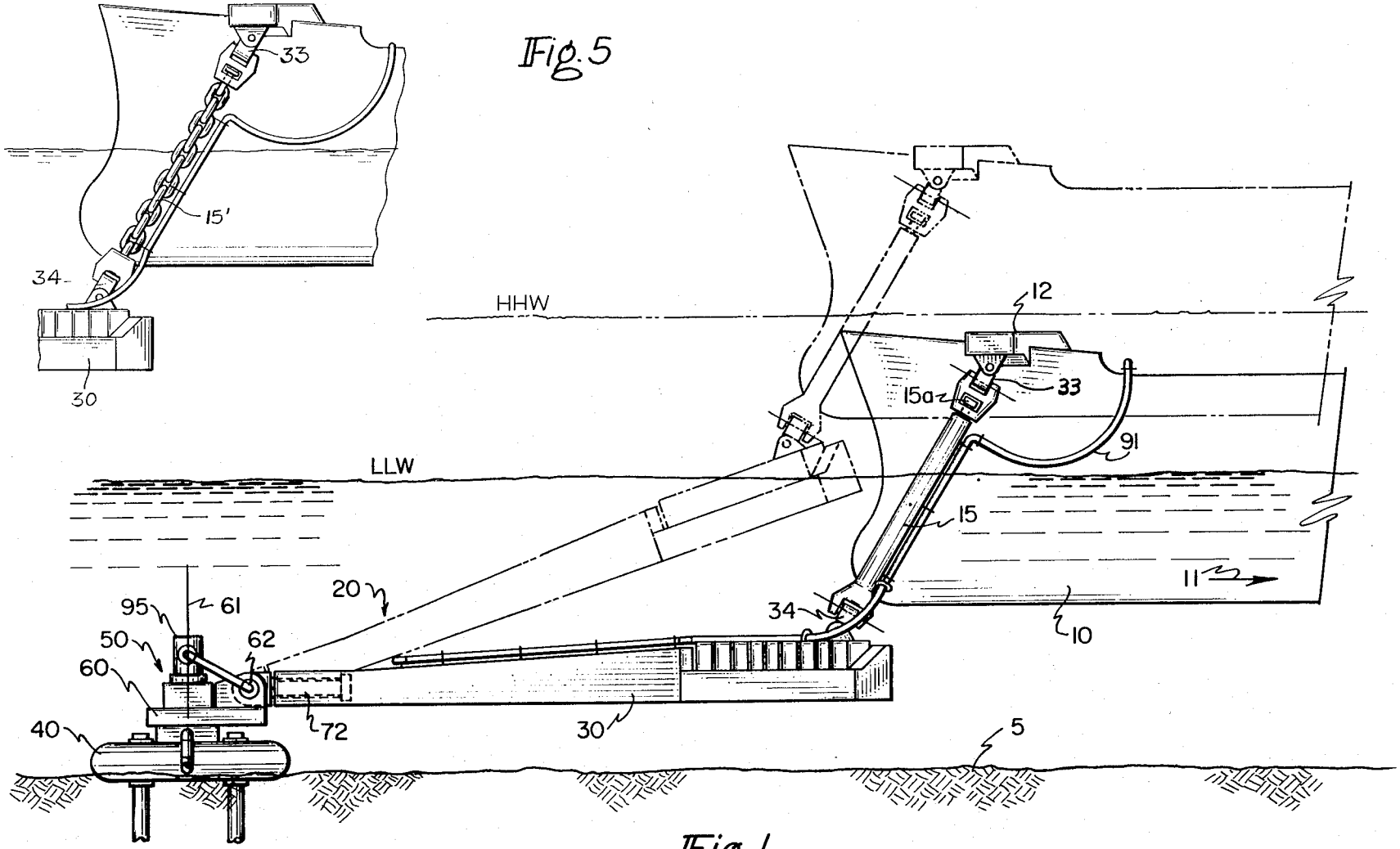
FIG. 1 is an elevation drawing showing the mooring system secured to the floor of the body of water and a vessel at two positions illustrating a heavily loaded vessel at low low water conditions and an empty vessel at high high water conditions.
FIG. 5 illustrates the suspending means as a chain.

FIG. 1 illustrates the submerged single point mooring apparatus of the invention in which a vessel 10 is shown moored to a mooring system shown generally at 20. The vessel is shown in two positions. The first shows the vessel floating under conditions of a low low water (LLW) of the body of water and moderate forces acting on the vessel tending to force the vessel away from the mooring. the second, at a high high water condition (HHW) is also illustrated under conditions tending to force the vessel away from the mooring. Under conditions of a fully loaded vessel at LLW, the yoke suspension means 15 is selected such that the yoke 30 securing the vessel 10 to a mooring base 40 is substantially horizontal and parallel to the floor of the body of water 5.

A triaxial articulation means 50 allows the yoke 30 to move in yaw, pitch and roll in response to such motions on the ship 10 with respect to mooring base 40. Yoke suspension means 15 connects the outer ends of arms 31 and 32 of yoke 30 to mooring brackets 12 on the vessel. The yoke suspension means 15 may advantageously be heavy chains or multiple wire rope tendons or alternatively may be a rigid metallic shaft with swivel means 15*a* for axial swiveling of one end relative to the other. The yoke suspension means 15 in combination with universal joints 33 and 34 connected to the vessel and to an outer end of a yoke arm advantageously allow a strain and wear free three degree of freedom rotation between the yoke suspension means 15 and the vessel 10 or the outer ends of yoke 30. Under conditions of an empty vessel at HHW, the yoke 30 is inclined upwardly with respect to the floor of the body of water 5.

Figure 2:
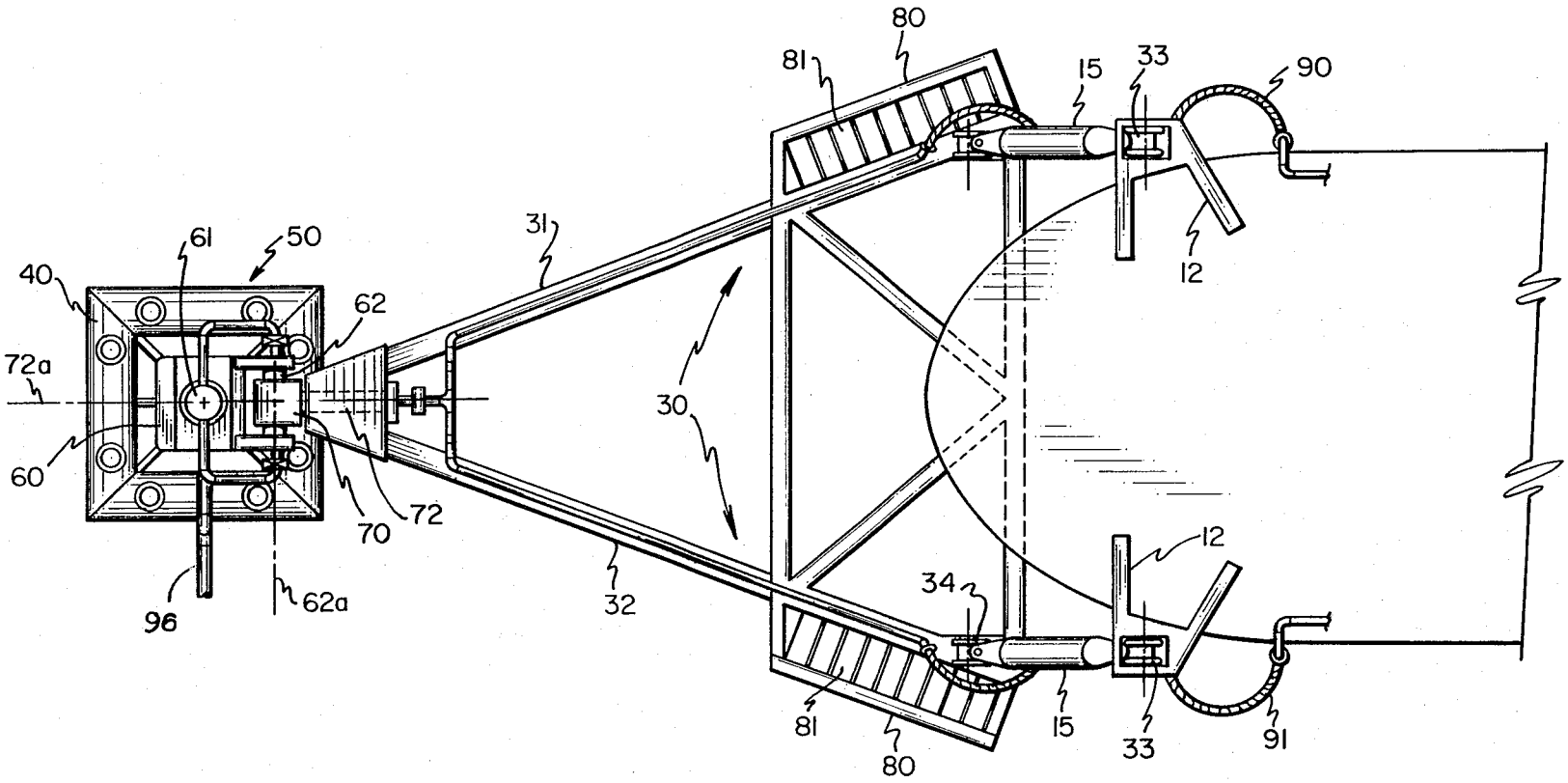
FIG. 2 is a plan view of the mooring system showing the "V" shaped nature of the submerged yoke and a preferred piping system.

FIG. 2 shows a plan view of the submerged single point mooring apparatus. The triaxial articulation means shown generally at 50 consist of a turntable structure 60 mounted on the mooring base 40 and a coupling means 70 connecting the turntable 60 to the yoke 30. The turntable 60 is adapted for rotation about a vertical axis 61. A first pin 62 is mounted in the turntable structure 60 coaxial with pitch axis 62*a* and rotatably connects the coupling means 70 to the turntable structure 60. A second pin 72 is integral with the coupling means 70 and is oriented orthogonally to the first pin 62. The apex end of yoke 30 is free to rotate about pin 72. Thus the yoke 30 is free to yaw, pitch and roll about the three mutually orthogonal axis 61, 62*a* and 72*a* while securely attached to the submerged mooring base.

The outer ends of yoke 30 contain weight holding means 80 for securing heavy weights 81 which may be high density concrete blocks and the like sufficient to provide an adequate position restoring force to the vessel via yoke suspension means 15 as the suspension pendants are inclined as a result of wind, wave and current forces 11 acting on the moored vessel. The weighted yoke suspension means 15, universal joints 33 and 34 and yoke 30 in combination with triaxial articulation means 50 thus provide a resilient position restoring force to the vessel and simultaneously allows the moored vessel to surge, heave, sway, pitch, yaw and roll in response to wind, wave and current forces.

Flexible conveying hoses 90 and 91 are provided for connection from either side of the vessel to piping along the yoke and to a product swivel 95 mounted on the triaxial articulation providing a conduit to a submarine pipeline 96. Alternatively, rigid piping with fluid transfer swivel articulations may be provided.

Figure 3:
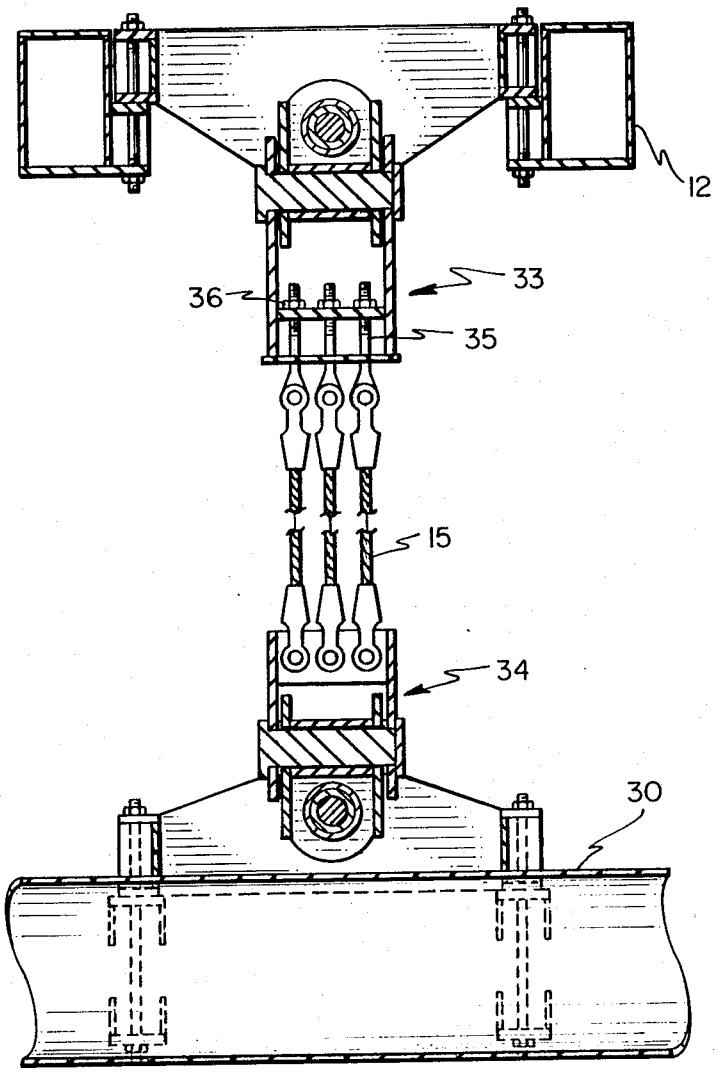
FIG. 3 is a detailed view of one embodiment of the yoke suspension means including multiple wire rope suspension tendons connecting the open end of the yoke with the mooring vessel.

FIG. 3 shows a detailed view of yoke suspension means 15 and universal joints 33 and 34 in the embodiment where the suspension means are multiple wire rope tendons. Only three tendons are shown while in actuality there may be several rows of tendons with two or more tendons in each row. This embodiment of suspension means 15 will absorb twisting of the suspension tendons (due to yawing motions of the yoke and the vessel) without need for special axial swiveling means.

An important feature of this embodiment of suspension means 15 is the arrangement provided for equalizing the loads on the individual tendons. The wire rope tendons are attached at one end, preferably at the upper universal joint 33, to threaded rods 35 with adjustment nuts 36. This arrangement permits adjustment of the tension in each individual tendon and also easy replacement of single tendons while the yoke weight remains suspended on the remaining tendons.

Figure 4:
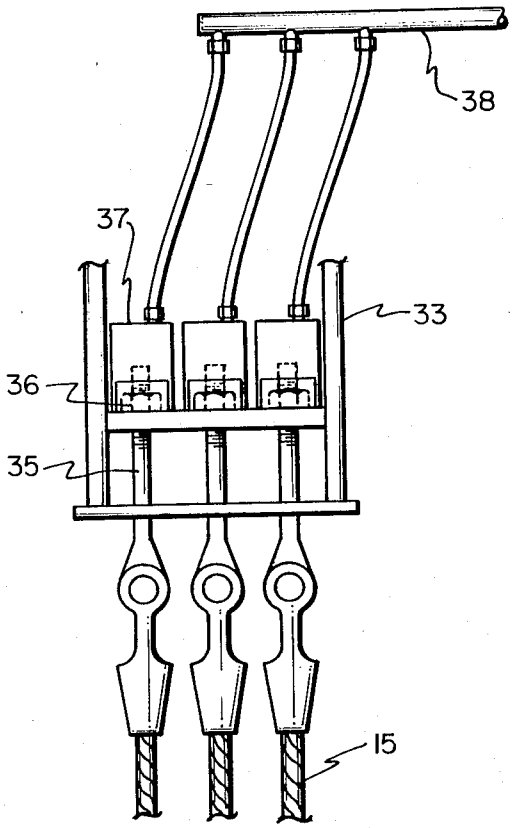
FIG. 4 is a detail of a hydraulic tensioning arrangement for equalizing the load on the multiple wire rope suspension tendons illustrated in FIG. 3.

FIG. 4 shows the preferred means of equalizing the tension of the tendons. Each of the individual tendons in a group of multiple tendons will be tensioned simultaneously by standard hydraulic bolt tensioners 37. The hydraulic tensioner grips the outer end of the threaded rods 35 and pulls the tendons 15 to the required tension. The stop nuts 36 are then seated tight while the hydraulic tension is still effective, after which the hydraulic pressure is released and the hydraulic tensioners 37 removed.

FIG. 5 illustrates that the suspending elements may be single or multiple chains.

All hydraulic tensioners 37 will be in one group of tendons and be pressurized from a common hydraulic pressure line 38, thus insuring equal tension in all tendons in the group regardless of differences in initial length or different stretch ratios for individual tendons.

Thus there has been provided a single point mooring system according to the invention in which the mooring base and yoke are preferably submerged under extreme conditions of either low low water and heavy loading of the vessel or high high water and empty loading of the vessel. Such a completely submerged mooring system provides a means for mooring a vessel to an offshore pipeline or the like while substantially protecting the mooring and the yoke from ice flows and heavy sea conditions. The system provides a resilient restoring mooring force to the vessel in response to forces tending to force the vessel away from the mooring and provides a means for connecting the vessel to a fixed mooring base while allowing for surge, sway, heave, yaw, pitch and roll motions of the vessel.

Various modifications and alterations in the described structures will be apparent to those skilled in the art of the foregoing description which does not depart from the spirit of the invention. For this reason, these changes are desired to be included in the appended claims. The appended claims recite the only limitations to the present invention and the descriptive manner which is employed for setting forth the embodiments and is to be interpreted as illustrative and not limitative.

What is claimed is:

1. Mooring apparatus for mooring and loading or discharging a vessel in a body of water comprising, submerged mooring base means secured to the floor of the body of water, submerged unitary yoke means attached at its first end directly to the mooring base means by a triaxial articulation means for allowing the yoke means to move in yaw, pitch, and roll with respect to the submerged mooring base means, yoke suspension means connected between the submerged second end of the yoke means and the vessel, weighting means removably disposed in the second end of the yoke for providing in combination with the yoke, triaxial articulation means and yoke suspension means a self-acting resilient restoring force to the vessel with respect to the mooring base, wherein the yoke means comprises a "V" shaped member having its apex end connected to the triaxial articulation means and having weight holding means disposed outwardly along the two arms of the "V", wherein the yoke suspension means comprises first and second suspension elements connected between the outward ends of the two arms and support brackets on port and starboard sides of the vessel, and wherein the first and second suspension elements are connected between universal joints mounted on the sides of the vessel and on the outward ends of the two arms of the yoke.

2. The apparatus of claim 1 wherein the first and second suspension elements are single or multiple chains.

3. The apparatus of claim 1 wherein the first and second connecting elements are multiple wire rope tendons with means for equalizing the tension in all tendons on each of the first and second suspension elements.

4. The apparatus of claim 1 wherein the first and second suspension elements are rigid shafts with means for axial swiveling of one end relative to the other.

5. Mooring apparatus for mooring and loading or discharging a vessel in a body of water comprising, a mooring base secured to the floor of the body of water, a non-buoyant triaxial articulation structure submergedly secured to said mooring base, said structure having a connector which may move with three degrees of freedom with respect to said mooring base, a submerged "V" shaped yoke having its apex end connected to said triaxial articulation structure connector, yoke suspension means connected between the ends of each outer arm of the "V" shaped yoke and port and starboard sides of said vessel for connecting said vessel to said mooring base, said triaxial articulation structure and said "V" shaped yoke allowing said vessel to move in yaw, pitch and roll with respect to said mooring base, and weights removably disposed in the outer ends of each outer arm of the "V" shaped yoke, operably providing in combination with the yoke, triaxial articulation structure and yoke suspension means, a self-acting resilient restoring force to the vessel with respect to the mooring base.

6. The apparatus of claim 5 wherein the triaxial articulation structure comprises, a turntable mounted on said mooring base operably rotatable about a vertical axis, a coupling mounted on said turntable and rotatable about a first pin disposed substantially horizontally and parallel to the turntable plane of rotation, and a second pin oriented substantially orthogonally to said first pin and mounted rigidly with respect to said coupling and rotatably connected to said submerged "V" shaped yoke with its rotation axis aligned substantially along the longitudinal axis of the submerged "V" shaped yoke.

7. The apparatus of claim 5 wherein the yoke suspension means comprises first and second suspension elements connected between the outward ends of the two arms and support brackets on port and starboard sides of the vessel.

8. The apparatus of claim 5 wherein the first and second suspension elements are connected between universal joints mounted on the sides of the vessel and on the outward ends of the two arms of the yoke.

9. The apparatus of claim 8 wherein the first and second suspension elements are single or multiple chains.

10. The apparatus of claim 8 wherein the first and second connecting elements are multiple wire rope tendons with means for equalizing the tension in all tendons on each of the first and second suspension elements.

11. The apparatus of claim 8 wherein the first and second suspension elements are rigid shafts with means for axial swiveling of one end relative to the other.

12. The mooring system of claim 5 further comprising piping and flexible hose means connected between the storage vessel and the submerged mooring base for providing a fluid flow-conveying connection between the submerged mooring base means the vessel.

* * * * *